United States Patent [19]

Casutt

[11] 4,240,337

[45] Dec. 23, 1980

[54] PROCESS AND DEVICE FOR THE ERECTION OF CARDBOARD TRAYS

[76] Inventor: Toni Casutt, Blumenrain 24, 8702 Zollikon, Switzerland

[21] Appl. No.: 934,471

[22] Filed: Aug. 17, 1978

[30] Foreign Application Priority Data

Aug. 17, 1977 [CH] Switzerland ..... 10107/77

[51] Int. Cl.[3] ..... B31B 1/50

[52] U.S. Cl. ..... 493/137; 493/167

[58] Field of Search ..... 93/49 M, 49 R, 53 LF, 93/1 D, 36.05 R, 51 M, 51 R, 60; 229/DIG. 3, 41 B, 30, 35, DIG. 8

[56] References Cited

U.S. PATENT DOCUMENTS 3,913,466 10/1975 Bayer et al. ..... 93/53 LF 4,079,853 3/1978 Casutt ..... 229/35

*Primary Examiner*—R. L. Spruill

*Assistant Examiner*—K. Y. Lin

*Attorney, Agent, or Firm*—Frishauf, Holtz, Goodman & Woodward

[57] ABSTRACT

Trays are erected from cardboard blanks by insertion of bent edge parts into slits in tongues, the extent of insertion dictating the carrying capacity of the resulting tray. The edge parts are bent with a double fold using mechanical fingers to give a wedge-shaped insertion structure for engagement with the slits in the tongues. To stiffen the blank and simplify insertion, side walls of the blank are first bent up by a bending tool and then subsequently insertion fingers are pivoted against the edge parts to form the double fold, and insert it into the slits of the tongues.

10 Claims, 6 Drawing Figures

PROCESS AND DEVICE FOR THE ERECTION OF CARDBOARD TRAYS

The invention relates to the mechanical erection of cardboard trays, particularly for holding fruits and vegetables, from flat blanks of the kind having a base, a pair of parallel side walls connected to the base, two tongues each having an insertion slit, and two edge parts surrounding the tongues on the outside thereof and merging with the side walls.

BACKGROUND AND PRIOR ART

The mechanical erection of a tray from a blank of the kind described above has hitherto presented difficulties because each edge part, which is guided during erection by the inward movement of a mechanical finger into the slit of the respective tongue, has the tendency to bend together with the respective tongue about a line somewhat coaxial with the pivot line, or root of the tongue.

Due to this, it is no longer possible to form a double bend from an outer edge part surrounding the tongue, and to insert a wedge-shaped portion thereof into the tongue slit.

THE INVENTION

It is an object to provide a method and a device for the erection of a tray from a blank of the kind described above, by mechanical means, in a simple and operationally reliable manner.

The side walls are first bent up from the level of the base; then the edge parts adjacent to the tongues are each formed, by two mechanical fingers, in shape of a dual arch having a central wedge-shaped insertion part. The wedge shaped part which actually is composed of the end portions of each of the edge parts is then pushed into the slit of the raised tongues.

According to a feature of the invention an erection apparatus is provided which comprises two movable fingers and finger driving mechanisms for pushing the insertion parts formed from the edge parts of the blank into the tongue slit, a matrix and a die, shaped to erect the side walls and the tongues, drive mechanisms for the fingers and drive mechanisms for the production of a relative movement between the die and the matrix, the finger drive mechanisms being so formed and/or controlled that firstly the side walls are bent away from the level of the base and, after this, the fingers form the edge parts.

With this arrangement the tray can be erected in a particularly simple manner without requiring a complicated mechanism for the formation of the insertion parts.

The invention will now be described further by way of example only and with reference to the accompanying drawings in which.

Figure 1:
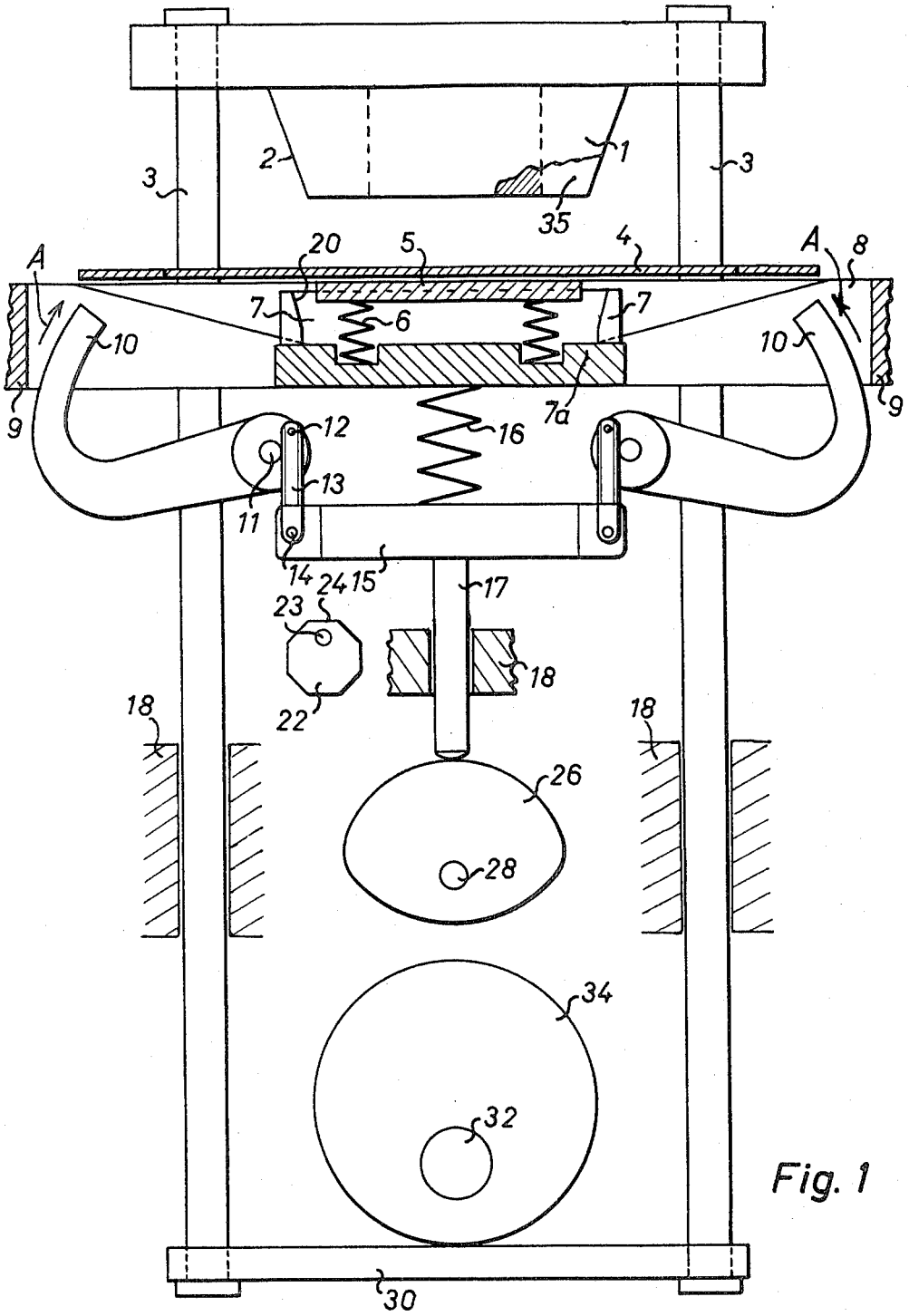
FIG. 1 shows one form of a device according to the invention for the erection of cardboard boxes in schematic presentation.
Figure 2:
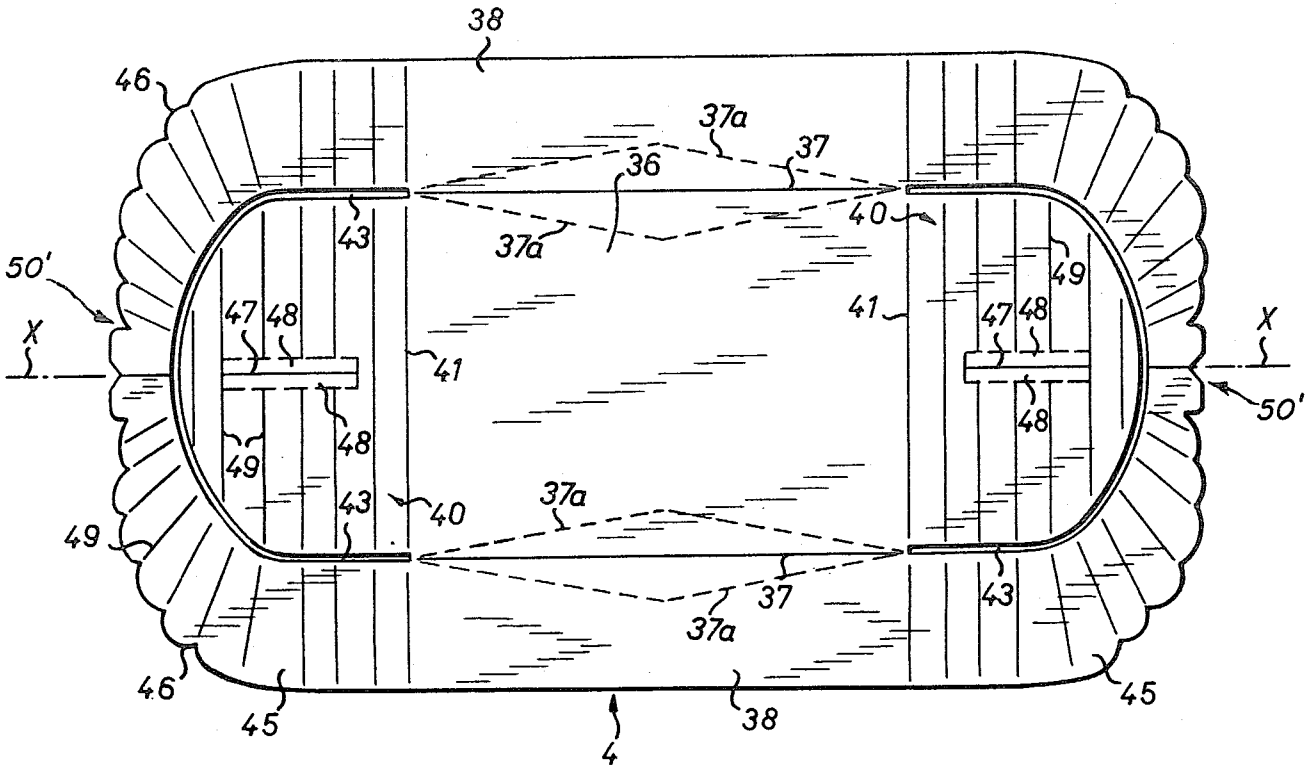
FIG. 2 is a top view of a flat cardboard blank.
Figure 3:
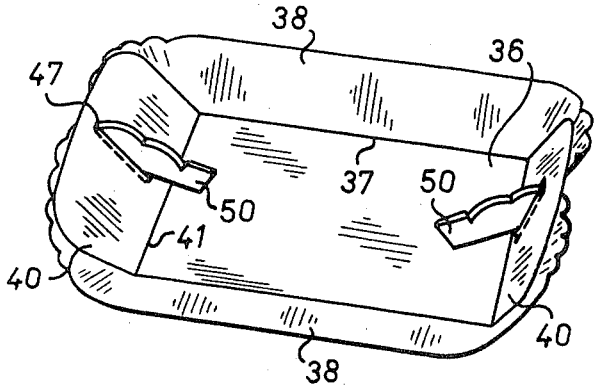
FIG. 3 is a perspective presentation of the erected tray with insertion parts pushed relatively far into the tongue slit.
Figure 4:
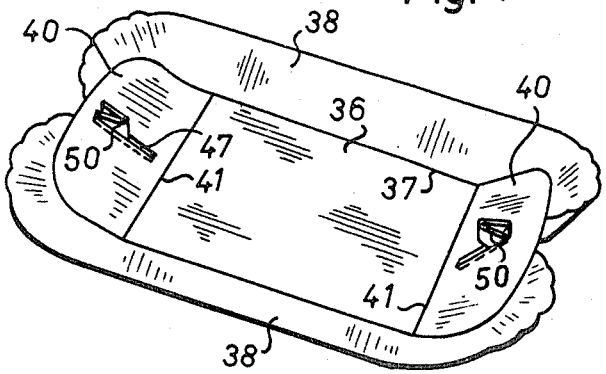
FIG. 4 is a perspective presentation of the erected tray with little insertion of the insertion parts.

With the device according to FIG. 1, trays for fruits and vegetables can be formed from flat cardboard blanks 4 (FIG. 2) as can be seen in FIGS. 3 and 4. By greater or smaller penetration of the insertion parts into the tongue slits, the carrying capacity of the trays can be varied, while using the same blanks.

The blank 4 according to FIG. 2 has a base 36 of, generally rectangular shape. Two strip-shaped side walls 38, parallel to each other, are connected with the base 36, by score or bending lines 37. Two tongues 40 border on the base and are connected to the base 36 by score, or bending lines 41 on the base of the tongue. The bending lines 37 and 41 extend at right-angles to each other. Both tongues 40 are each separated by a generally U-shaped slit 43 from a respective edge part 45. The edge parts 45 connect with the side walls 38. These edge parts 45 are corrugated or scalloped on the outer rim 46. The width of the edge parts 45 decreases in the direction of the longitudinal axis X of the blank A slit 47 is formed. In the middle of each of the tongues extending parallel to the longitudinal axis X, the slit 47 is bordered by bendable strip-type flaps 48 arranged on both sides thereof. Bending or score lines 49 are formed on the tongues 40, and on the edge parts 45, in the form of a pressed-in grooves in order to facilitate the bending of these parts during the erection process of the tray.

Erection apparatus with reference to FIG. 1: two curved mechanical fingers 10 engage the central region 50' (FIG. 2) of the edge parts 45, and thus form double ply insertion portions 50 (FIGS. 3, 4). The fingers 10 push the portions 50 more less deeply into the tongue slits 47, so that trays with larger capacity, according to FIG. 4, or with smaller carrying capacity according to FIG. 3, are formed.

The device according to FIG. 1 also comprises a die 1 moving up and down through a column support 3 in guideways of a machine bedplate 18.

The blank 4, flat at the beginning, rests on the spring-cushioned supporting plat 5 of a stationary bending matrix 7. This blank is shaped as shown in FIG. 2. The supporting plate 5 is supported underneath by springs 6 which rests on the matrix base.

The two fingers 10 are positioned underneath the bending matrix 7, arranged to swivel on horizontal axes 11. These fingers penetrate slit 8 in a stationary plate 9. The swivelling of the fingers 10 is effected by a bolt 13, one for each finger, which is connected by a pin 12 on the finger 10. These bolts 12 are pivotably fastened with pins 14 to a common arm 15. From this arm a follower rod 17 projects downwards, which is moved up and down in a guideway of the machine bedplate 18 and lies underneath the bedplate 18 against an eccentric cam 26. The eccentric cam 26 is rotatable around a horizontal shaft 28. Between the tray bending matrix 7 and the arm 15 there is a pressure spring 16 which exerts a downwardly directed force on arm 15 and accordingly holds the arm 17 in contact with the eccentric cam 26. The eccentric cam 26 is so formed that, at the beginning of its turning movement, it presents a part somewhat coaxial to the shaft 28, so that the fingers 10 move, at first, not at all or only a little.

The stroke which the arm 15 can carry out upon movement of the eccentric cam 26 is limited by an eccentrically adjustable buffer or stop 22. The buffer or stop 22 is rotatable by hand around a horizontal axis 23. Thus the arm 15 will engage a selected one of the surfaces 24. According to the rotated position of this buffer 22, the maximum stroke of the arm 15 and thus the angle of traverse of the finger 10 is limited. The lower end of the rod 17 can be lifted temporarily off the eccentric cam 26 in selected pivot positions of buffer 22.

Figure 5:
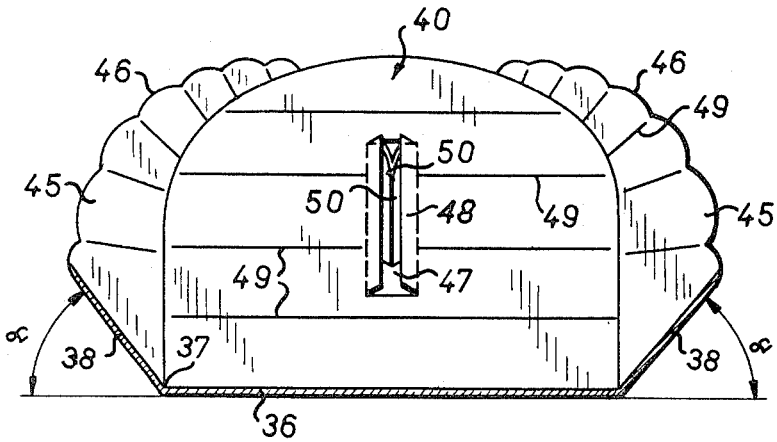
FIG. 5 is a vertical section through the erected tray.
Figure 6:
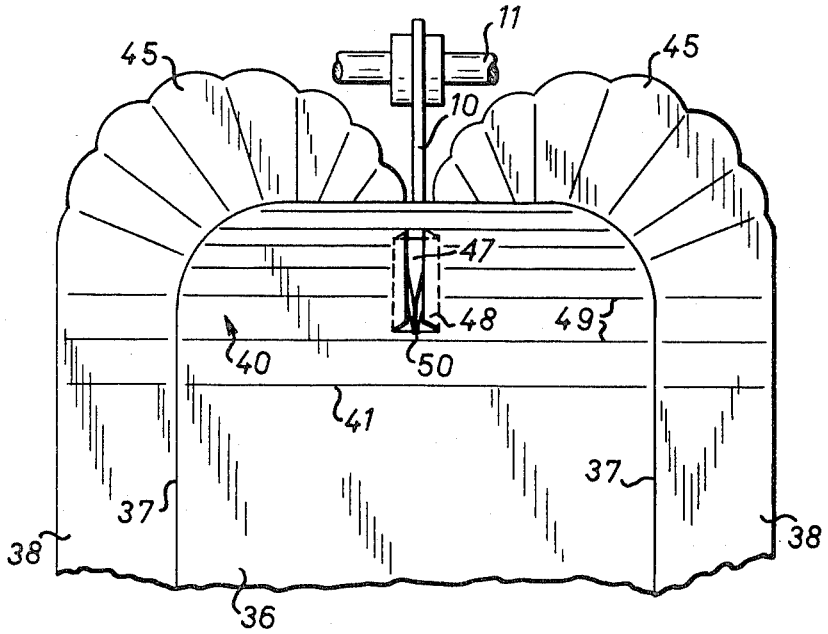
FIG. 6 is a partial top view of the tray during the process of erection.

The movement of the die 1 is effected by a further eccentric cam 34 which is rotatable by means of a shaft 32. The support 3 has a connecting part 30 which lies beneath and against the eccentric cam 34. When this eccentric cam 34 turns—starting from the position shown in FIG. 1, the die 1 drops and comes to lie, after free movement, against the cardboard blank 4. Upon further downward movement of the die 1, the supporting plate 5 lying against the base 36 of the blank 4 drops, whereupon the inclined circumferential planes 20 of the bending matrix 7 bend upwards obliquely, first the two side walls 38 and then transversely thereto the tongues 40, upon from the plane of the base 36. The movements of the die 1 and of the fingers 10 are so synchronized to each other, or controlled, that firstly the two side walls 38 along the bending lines 37 are bent up and accordingly at least partially erected before the fingers 10 lift up the center zone 50' of the two edge parts 45 from which the two insertion parts 50 are formed, and deform their middle region into a wedge shape. The reason for this is: by this movement cycle a lateral stiffening of the arch-shaped edge part 45 of the blank 4 occurs, which prevents these two edge parts 45, upon the engagement with the fingers 10, from bending upwardly around a bending line somewhat coaxial to the bending line 41 at the root of the tongue; such upward bending would make insertion of the insertion parts 50 into the slits 47 impossible at the position of the raised insertion parts 50 would come to lie largely above the tongue slit 47. However, as soon as the side walls 38 form an angle $\alpha$ (FIG. 5) with respect to the base, the edge parts form automatically a double arch upon engagement with the pivoting fingers 10 and, without additional auxiliary means, also form the wedge-shaped insertion part 50, as is shown in FIG. 6.

A slit 35 is formed on both sides of the die 1 in which the fingers 10 and the insertion part 50 can engage. The tongues 40 lie against the inclined planes 2 of the die 1, and also against the inclined planes 20 of the bending matrix 7. According to the adjusted position of the buffer 22, the fingers 10 now penetrate more or less deeply into the slits 35 of the die 1, so that the varying tray sizes can be formed. The corrugated or scallop-formed outer rim 46 of the insertion part 50 lies against the upper end of slit 47 in the tongue 40 and locks the insertion part 50 in the desired relative position between the tongue 40 and the insertion part 50.

After the complete erection of the tray, the fingers 10 are reset and the tray is discharged from the device. Preferably the whole device is positioned tilted with respect to the horizontal so that the tray can fall by gravity on a chute or the like.

The two eccentric cams 26 and 34 are driven at equal speeds by gear wheels or geared belts. It is also possible to arrange both these eccentric cams 26, 34 on the same shaft, and drive them together with a motor.

In place of the rectilinear bending line 37 between base 36 and side walls 38, on each a double bending line **37*a* could be provided formed as a flat parallelogram, as shown in FIG. 2**.

I claim:

1. Method for mechanical erection of a cardboard tray, particularly for holding fruits and vegetables, in which the tray is formed from a flat blank having a base (36), a pair of parallel side walls (38) connected to the base, two tongues (40) each having an insertion slit (47) connected to the base and positioned transverse with respect to said walls, one at each end thereof, and two edge parts (45) surrounding the tongues on the outside thereof, merging with the side walls, and separated from the tongue by separating cuts (43);

comprising the steps of (a) first bending the sidewalls (38) angularly away from the level of the base (36);

(b) bending the tongues (40) angularly away from the level of the base;

(c) then engaging the central portions (50') of the edge parts (45) with mechanical fingers (10) to fold said central portions and form double ply insertion parts (50) with the mechanical fingers between the plies of the respective insertion parts;

(d) introducing the insertion parts, with the fingers therebetween, into the slits (47) of the raised tongues;

(e) and withdrawing said fingers (10) from between the plies of the insertion parts (50), said insertion parts remaining locked in said slits.

2. Method according to claim 1 including a step of controlling the depth of insertion of the fingers (10) and hence of the insertion parts (50) into the slits (47) of the tongues.

3. Apparatus for the mechanical erection of a cardboard tray, particularly for holding fruits and vegetables, from a flat blank having a base (36), a pair of parallel side walls (38) connected to the base, two tongs (40) each having an insertion slit (47) connected to the base and positioned transverse with respect to said walls, one at each end thereof, and two edge parts (45) surrounding the tongues on the outside thereof, merging with the side walls, and separated from the tongue by separating cuts (43)

comprising in accordance with the invention a frame (18);

a die (1) movably mounted in the frame;

a matrix (7) provided beneath said die and a supporting plate (5) provided on said matrix;

two movable fingers means (10) mounted below said matrix;

and die moving means (30, 32, 34) to effect relative movement between the die (1) and the matrix (7), wherein said fingers means are located oppositely from each other and positioned with respect to the edge parts (45) of the blank to engage the central portion (50') of the edge parts;

the die drive means moving the die (1) against said blank (4) to push the blank against the matrix and thus bend the sidewalls (38) and the tongue (40) with respect to the matrix to form said tray with raised side walls and end tongues;

and said finger drive means (26, 28) are synchronized with the die drive means (30, 32, 34) to then move the fingers means in engagement direction with respect to the central portions (50') of said edge parts and thereby fold said edge parts centrally into double-ply configuration with the fingers means therebetween, said finger drive means continuing control of movement of said fingers means in a direction towards the slit (47) on the raised tongues.

4. Apparatus according to claim 3 wherein the fingers means are bent into hook-shape.

5. Apparatus according to claim 4 wherein the finger drive means comprises an eccentric cam (26).

6. Apparatus according to claim 3 wherein the die moving means comprises an eccentric cam driven synchronously with respect to the finger drive means.

7. Apparatus according to claim 4 including pivot means (11) supporting the finger means beneath the matrix (7);

link means (13, 14) connected to the fingers means eccentrically with respect to the pivot axis thereof;

a connecting arm (15) connecting said link means;

a lifting cam (26, 17) forming said finger drive means in engagement with said connecting arm;

bias means (16) maintaining said connecting arm in engagement with the cam means.

8. Apparatus according to claim 7 further including adjustable stop means (22, 23) selectively positionable in interfering relation with respect to the connecting arm (15) to limit the extent of pivoting movement of the fingers means (10) and thus selectively adjust the depth of penetration of the fingers means and hence of the insertion parts (50) into said slits (47).

9. Apparatus according to claim 3 including lateral slits (35) formed in a die (1) to receive the fingers means (10) and the insertion parts (50) surrounding the fingers upon engagement of the fingers means of the central portions (50') of the edge parts (45).

10. Apparatus according to claim 3 wherein the fingers means are in the shape of bent-hooks pivoted at one end about pivot axes (11) located beneath the matrix (7);

link means (12, 13, 14, 15) connecting said fingers means;

and wherein the finger drive means comprises cam means (26, 28) in engagement with said link means;

and the die drive means comprises eccenter means (30, 32, 34) coupled to the die, and driven in synchronism with said cam means, for synchronous controlled sequential movement of the die (1) and, subsequently, of the fingers means for initial erection of the side walls and tongues of the blank (4) from the base (36) and subsequent formation of the folded insertion parts (50) for insertion in the slits (47) of the tongues (40).

* * * * *